US008784620B2

(12) United States Patent
Schussler et al.

(10) Patent No.: US 8,784,620 B2
(45) Date of Patent: Jul. 22, 2014

(54) METHOD OF OPERATING A DIAPHRAGM ELECTROLYTIC CELL

(75) Inventors: Henry W. Schussler, Harrison City, PA (US); David R. Bush, Lake Charles, LA (US); Craig R. Long, Lake Charles, LA (US)

(73) Assignee: Axiall Ohio, Inc., Atlanta, GA (US)

( * ) Notice: Subject to any disclaimer, the term of this patent is extended or adjusted under 35 U.S.C. 154(b) by 132 days.

(21) Appl. No.: 13/104,086

(22) Filed: May 10, 2011

(65) Prior Publication Data

US 2011/0278177 A1 Nov. 17, 2011

Related U.S. Application Data

(60) Provisional application No. 61/334,387, filed on May 13, 2010.

(51) Int. Cl.
*C25B 13/08* (2006.01)
*C25B 1/46* (2006.01)

(52) U.S. Cl.
CPC ..... *C25B 13/08* (2013.01)
USPC ..... 204/296; 204/252; 204/253; 204/257; 204/263; 204/295; 205/350; 205/517

(58) Field of Classification Search
CPC ..... C25B 13/08
USPC ..... 204/252–266, 295, 296; 205/350, 205/510–537, 703
See application file for complete search history.

(56) References Cited

U.S. PATENT DOCUMENTS

| | | | | | |
|---|---|---|---|---|---|
| 4,036,729 | A | | 7/1977 | Patil et al. | |
| 4,126,536 | A | | 11/1978 | Balko et al. | |
| 4,174,266 | A | * | 11/1979 | Jeffery | 205/350 |
| 4,680,101 | A | | 7/1987 | Darlington et al. | |
| 4,853,101 | A | | 8/1989 | Hruska et al. | |
| 5,188,712 | A | | 2/1993 | Dilmore et al. | |
| 5,470,449 | A | * | 11/1995 | Bachot et al. | 204/252 |
| 5,567,298 | A | | 10/1996 | DuBois et al. | |
| 5,612,089 | A | | 3/1997 | Dilmore, Jr. et al. | |
| 5,630,930 | A | | 5/1997 | Maloney | |
| 5,683,749 | A | | 11/1997 | DuBois et al. | |
| 5,919,348 | A | * | 7/1999 | Friedrich et al. | 205/350 |
| 6,059,944 | A | | 5/2000 | DuBois et al. | |
| 6,296,745 | B1 | | 10/2001 | DuBois et al. | |
| 6,299,939 | B1 | | 10/2001 | DuBois et al. | |
| 7,459,044 | B2 | | 12/2008 | Khan et al. | |
| 7,618,527 | B2 | * | 11/2009 | Schussler et al. | 205/350 |
| 2007/0163890 | A1 | | 7/2007 | Schussler | |
| 2008/0289956 | A1 | | 11/2008 | Schussler | |

FOREIGN PATENT DOCUMENTS

| | | |
|---|---|---|
| WO | WO2008030216 | 3/2008 |

* cited by examiner

*Primary Examiner* — Keith Hendricks
*Assistant Examiner* — Salil Jain
(74) *Attorney, Agent, or Firm* — The Webb Law Firm

(57) ABSTRACT

Described is a method for improving the operation of an electrolytic cell having an anolyte compartment, a catholyte compartment and a synthetic diaphragm separating the compartments, wherein liquid anolyte is introduced into the anolyte compartment and flows through the diaphragm into the catholyte compartment, which method involves introducing particulate material comprising halocarbon polymer short fiber, e.g., fluorocarbon polymer short fiber, into the anolyte compartment in amounts sufficient to lower the flow of liquid anolyte through the diaphragm into the catholyte compartment. In the case of an electrolytic cell wherein aqueous alkali metal chloride, e.g., sodium chloride, anolyte is introduced continuously into the anolyte compartment, thereby to produce a catholyte liquor containing alkali metal hydroxide and hypochlorite ion, the foregoing method is useful for decreasing the concentration of hypochlorite ion in the catholyte liquor and oftentimes increasing the concentration of alkali metal hydroxide in the catholyte liquor. Also describes adding at least one member chosen from halocarbon polymer microfibril, halocarbon polymer fiber, clay mineral, oxides and/or hydroxides of alkaline earth metals, and zirconium oxide/hydroxide in conjunction with the halocarbon polymer short fiber to the anolyte compartment, e.g., while the cell is operating.

11 Claims, No Drawings

METHOD OF OPERATING A DIAPHRAGM ELECTROLYTIC CELL

CROSS-REFERENCE TO RELATED APPLICATIONS

This application claims the priority of Provisional Patent Application Ser. No. 61/334,387 filed May 13, 2010 and entitled METHOD OF OPERATING A DIAPHRAGM ELECTROLYTIC CELL.

FIELD OF THE INVENTION

The present invention relates to electrolytic diaphragm cells for the electrolysis of inorganic materials, e.g., alkali metal chloride, and to methods for operating such electrolytic cells so as to minimize the effect of perforations that occur in the diaphragm of the electrolytic cell, e.g., a chlor-alkali electrolytic cell.

BACKGROUND OF THE INVENTION

Electrochemical processing of inorganic chemicals in electrolytic diaphragm cells for the production of other inorganic materials is well known. The electrolytic cell generally comprises an anolyte compartment containing an anode, a catholyte compartment containing a cathode, and a microporous diaphragm that separates the anolyte compartment from the catholyte compartment. Microporous diaphragms are used, for example, to separate an oxidizing electrolyte from a reducing electrolyte, a concentrated electrolyte from a dilute electrolyte, or a basic electrolyte from an acidic electrolyte.

A non-limiting example of a diaphragm electrolytic cell is the electrolytic cell that is used for the electrolysis of aqueous alkali metal halide solutions (brine). In such an electrolytic cell, the diaphragm is generally present on the cathode used in the cell, and separates an acidic liquid anolyte from an alkaline catholyte liquor. The electrolysis of alkali metal halide brine generally involves introducing liquid brine into the anolyte compartment of the cell and allowing the brine to percolate through the brine-permeable microporous diaphragm into the catholyte compartment. The microporous diaphragm is sufficiently porous to allow the hydrodynamic flow of brine through it, while at the same time inhibiting the back migration of hydroxyl ions (during electrolysis) from the catholyte compartment into the anolyte compartment. When direct current is applied to the cell, halogen gas is evolved at the anode, hydrogen gas is evolved at the cathode, and an aqueous alkali metal hydroxide solution is formed in the catholyte compartment. In the case of aqueous sodium chloride solutions, the halogen produced is chlorine and the alkali metal hydroxide formed is sodium hydroxide. Catholyte liquor comprising alkali metal hydroxide and unconverted brine is removed from the catholyte compartment of the cell.

During electrolysis, it is not unusual for the diaphragm of a diaphragm electrolytic cell to develop perforations (holes), which allow too high a flow of liquid anolyte into the catholyte compartment if the driving force on the liquid anolyte remains constant. Additionally, perforations can occur during initial electrolytic cell assembly or when such cells are disassembled for repair. When the flow of liquid anolyte into the catholyte compartment is too high, the concentration of the principal product formed in that compartment is lowered, which results in increased costs for unit operations employed to work-up, purify and concentrate that product, as well as an increase in the amount and cost of recycling process streams from those unit operations. In the case of a chlor-alkali electrolytic cell, too high a flow of brine through the diaphragm is evidenced by lower than desired concentrations of alkali metal hydroxide and higher than desired concentrations of hypochlorite ion in the catholyte liquor. When such a condition exists, there is a need for means to increase the resistance to flow, i.e., decrease the flow of anolyte, through the diaphragm due to perforations that may have developed in the diaphragm.

BRIEF SUMMARY OF THE INVENTION

In accordance with one aspect of the present invention, there is provided a method for improving the operation of an electrolytic cell comprising an anolyte compartment, a catholyte compartment and a synthetic diaphragm separating the anolyte and catholyte compartments wherein liquid anolyte is introduced into the anolyte compartment and flows through the diaphragm into the catholyte compartment, which method comprises introducing particulate material comprising halocarbon polymer short fiber into the anolyte compartment in amounts sufficient to lower the flow of liquid anolyte through the diaphragm into the catholyte compartment. The present invention provides also a further improvement in the operation of said electrolytic cell when aqueous alkali metal chloride is introduced continuously into the anolyte compartment and passes through the diaphragm into the catholyte compartment, which contains catholyte liquor comprising alkali metal hydroxide and hypochlorite ion, and wherein the concentration of alkali metal hydroxide is less than the desired concentration and/or the concentration of hypochlorite ion in the catholyte liquor is more than the desired concentration. Such improvement comprises introducing particulate material comprising halocarbon polymer short fiber into the anolyte compartment in amounts sufficient to decrease the concentration of hypochlorite ion in the catholyte liquor and/or increase the concentration of alkali metal hydroxide in the catholyte liquor.

DETAILED DESCRIPTION OF THE INVENTION

For purposes of this specification (other than in the operating examples), unless otherwise indicated, all numbers expressing quantities and ranges of ingredients, process conditions, etc are to be understood as modified in all instances by the term "about". Accordingly, unless indicated to the contrary, the numerical parameters set forth in this specification and attached claims are approximations that can vary depending upon the desired results sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Further, as used in this specification and the appended claims, the singular forms "a", "an" and "the" are intended to include plural referents, unless expressly and unequivocally limited to one referent.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements including that found in measuring instruments. Also, it should be understood that any numerical range recited herein is intended to include all sub-ranges subsumed therein. For example, a range of "1 to 10" is intended to include all sub-ranges between and including the recited minimum value of 1 and the recited maximum value of 10, that is a range having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

As used in the following description and claims, the following terms have the indicated meanings:

The term "halocarbon polymer" means a halogen-containing polymer, e.g., a chlorine-, fluorine- or chlorine/fluorine-containing polymer that is comprised principally of halogen(s), hydrogen, carbon and optionally oxygen, which polymer is at least partially resistant to the corrosive conditions within the anolyte compartment (and catholyte compartment) of the electrolytic cell into which short fibers of the halocarbon polymer are introduced. An example of a halocarbon polymer is a fluorocarbon polymer. Generally, the halocarbon polymer is non-conductive.

The term "fluorocarbon polymer" means a fluorine-containing polymer, e.g., polytetrafluoroethylene, which is comprised principally of fluorine, hydrogen, carbon and optionally oxygen. The fluorocarbon polymer may also contain other halogens, e.g., chlorine, such as polychlorotrifluoroethylene, and can comprise a mixture of halogen-containing polymers.

The term "halocarbon polymer fiber", "halogen-containing polymer fiber" or a term of like import, means a halocarbon polymer fibrous material, such as a polytetrafluoroethylene fiber, that has a mean length of at least 0.15 inch (0.38 centimeters), e.g., 0.25 inch (0.64 centimeters), and a mean diameter of approximately 20 to 30 microns, as measured by optical microscopy. The length and diameter of the typical commercial halocarbon polymer fiber. i.e., fiber strand, are not uniform because of manufacturing methods used to produce the fiber. However, the halocarbon polymer fiber typically has a mean length that is longer than the halocarbon short fiber described hereinafter. Commercial halocarbon polymer fiber material may be composed primarily of bundles of strands. The bundles can be up to 150 microns wide (as measured by optical microscopy) and have the appearance of a flat telephone cord.

The term "halocarbon polymer microfibril", halogen-containing polymer microfibril" or a term of like import, means an amorphous, non-rigid, pliable halocarbon polymer fiber material having a mean diameter of from approximately 150 to 300 microns, e.g., from 200 to 250 microns, as determined using a Coulter Laser Sizer. The microfibril diameter:length ratio is approximately 1:10. The halocarbon polymer microfibril material is irregularly shaped and not sphere-like.

The term "halocarbon polymer short fiber", "halogen-containing polymer short fiber" or a term of like import means a halocarbon polymer fiber material having a mean length of from 0.01 to 0.1 inch (0.025 to 0.25 centimeters), e.g., from 0.01 to 0.05 inch (0.025 to 0.13 centimeters), such as from 0.01 to 0.03 inch (0.025 to 0.076 centimeters), and a mean diameter of from 10 to 20 microns. The halocarbon polymer short fiber comprises thread-like filamentary materials that are typically regular in form, generally rigid and substantially cylindrical, although the ends of some of the filament strands can be frayed. Halocarbon polymer short fiber materials may be referred to herein as a "short fiber floc" or a "short fiber", e.g., a fluorocarbon polymer short fiber floc. Such short fiber floc material can be comprised of bundles of strands.

The term "chlor-alkali cell" or terms of like import means an electrolytic cell for the production of halogen, e.g., chlorine, and alkali metal hydroxide, e.g., sodium hydroxide or potassium hydroxide, by the electrolysis of aqueous alkali metal halide solutions, e.g., sodium chloride or potassium chloride solutions, which are often referred to as brine. The chlor-alkali cell described in the detailed description herein is a diaphragm electrolytic cell.

The term "diaphragm" means a microporous, liquid electrolyte permeable material that separates the anolyte compartment from the catholyte compartment of a diaphragm electrolytic cell. In a particular aspect of the present invention, the diaphragm of the described chlor-alkali electrolytic cell is a synthetic diaphragm.

The term "synthetic diaphragm" means a diaphragm that comprises fibrous organic polymeric materials that are substantially resistant to the internal corrosive conditions present in the electrolytic cell, e.g., a chlor-alkali electrolytic cell, particularly the corrosive environments found in the anolyte and catholyte compartments of the cell. In one aspect, the synthetic diaphragm is substantially free of asbestos, i.e., the synthetic diaphragm contains not more than 5 weight percent of asbestos. In alternate aspects, the synthetic diaphragm contains not more than 3, e.g., not more than 2 or 1, weight percent of asbestos, or is totally free of asbestos (a non-asbestos-containing diaphragm).

The term "electrolytic diaphragm cell" or "electrolytic cell" means an electrolytic cell for conducting an electrochemical process wherein an electrolyte is passed through a microporous diaphragm that separates the anolyte and catholyte compartments of the cell. In response to an electrical field that is generated between an anode contained in the anolyte compartment and a cathode contained in the catholyte compartment, the electrolyte is dissociated to synthesize other chemical materials, e.g., inorganic materials. In one aspect, the electrolytic cell is a chlor-alkali diaphragm cell wherein, for example, aqueous sodium chloride brine undergoes electrolysis to produce sodium hydroxide in the catholyte compartment and chlorine gas in the anolyte compartment.

The terms "on", "appended to", "affixed to", "adhered to" or terms of like import means that the referenced material is either directly connected to (superimposed on) the described surface, or indirectly connected to the object surface through one or more other layers (superposed on).

The term "perforation", as used in connection with the diaphragm of the electrolytic cell, means openings, e.g., holes, tears, etc, in the diaphragm through which the electrolyte, i.e., the anolyte, flows, which openings are of a size that are usually substantially larger than the original pores comprising the microporous diaphragm and that can cause the concentration of the principal product formed in the catholyte compartment during electrolysis to be reduced (diluted) to a level below that which is desired, e.g., to a level substantially below that which is desired during normal operation of the electrolytic cell. The term "perforation", as used herein, is intended to include thinned areas on the surface of the diaphragm, which although not technically a perforation allow higher rates of flow of electrolyte through the diaphragm compared to surrounding areas of the diaphragm. Such thinned areas may be caused, for example, by abrasion of the surface during handling or by excessive wear during operation of the electrolytic cell.

The term "at least partially resistant to the corrosive conditions within the anolyte compartment" or a term of like import, as used for example in reference to the halocarbon short fiber, means that the indicated material is at least partially resistant to chemical and/or physical degradation, e.g., chemical dissolution and/or mechanical erosion, by the conditions within the anolyte compartment for a reasonable period of time. Generally, a reasonable period of time will depend upon and be a function of the cell's operating conditions. In a non-limiting aspect, an electrolytic cell the diaphragm of which has been treated with halocarbon short fiber will return to acceptable levels of operation after equilibrium is reached for at least 2 weeks before the addition of further amounts of the short fiber (and/or other dopant material) may be required. In a particular aspect of the present invention, the electrolytic cell the diaphragm of which has been treated with halocarbon short fiber will return to acceptable levels of operation for from 2 to 12 weeks or more before the addition of further amounts of halocarbon short fiber (and/or other dopant material) may be required. Acceptable levels of operation are generally the operating conditions that existed for the particular treated cell prior to event(s) that necessitated addition of the short fiber.

The term "dopant material" means particulate material that is introduced into the anolyte compartment of an electrolytic diaphragm cell in order to regulate the microporosity of the diaphragm. The particulate dopant material is thereby deposited on the anolyte side of the surface of the diaphragm. Dopant material may be inorganic materials and/or organic materials. Dopant materials can be applied to the microporous diaphragm when it is first prepared, and during operation of the electrolytic cell to adjust the microporosity of the diaphragm, particularly during start-up of the cell. In a particular aspect, dopant material may include, but is not limited to, inorganic particulate material that comprises the topcoat applied to the diaphragm during preparation of the diaphragm. Non-limiting examples of inorganic dopant material include clay mineral, and the oxides and hydroxides of alkaline earth metals, e.g., magnesium. Organic materials that can be used as a particulate dopant material include, but are not limited to, halocarbon polymer microfibrils and halocarbon polymer fiber materials, the latter of which halocarbon polymer fibers have a mean length that is longer than the halocarbon polymer short fiber. Mixtures of inorganic materials, e.g., clay mineral, and organic materials, e.g., microfibrils, can be used as a dopant material.

For purposes of convenience, the following disclosure is directed specifically to chlor-alkali diaphragm electrolytic cells; but, as one skilled in the art can appreciate, the method of the present invention is also applicable to other diaphragm-containing electrolytic cells that are used for conducting an electrochemical process. In general, the electrochemical process is used for the electrolysis of inorganic materials, e.g., an aqueous inorganic metal salt solution, such as an aqueous sodium chloride solution, e.g., sodium chloride brine.

A variety of electrolytic cells (electrolyzers) known to those skilled in the art can be used for the electrolysis of aqueous alkali metal halide solutions. More particularly, the electrolyzers can be monopolar or bipolar cells that contain planar and non-planar electrodes, e.g., cathodes. Generally, electrolysis is performed in a plurality of housings comprising a plurality of individual electrolytic cell units wherein a succession of anode units alternate with cathode assemblies. A typical example of an electrolyzer is a bipolar electrolyzer wherein substantially vertical cathodes are interleaved or positioned within and spaced from substantially vertical anodes. This type of electrode assembly has been referred to as a fingered configuration, e.g., wherein a series of cathode fingers and anode fingers are interleaved with one another.

The cathode of a diaphragm electrolytic cell generally comprises a liquid-permeable substrate, e.g., a foraminous metal cathode. The cathode is electroconductive and may be a perforated sheet, a perforated plate, metal mesh, expanded metal mesh, woven screen, an arrangement of metal rods or the like having equivalent openings (nominal diameter) generally in the range of from 0.05 inch (0.13 cm) to 0.125 inch (0.32 cm). In one particular aspect, a perforated plate having ⅛ inch (0.32 cm) diameter holes on 3/16 inch (0.48 cm) centers can be used. Alternatively, the openings in the foraminous metal cathode can range from 0.07 inch (0.17 cm) to 0.1 inch (0.25 cm). Typically, the thicker the perforated sheet or plate, the larger the openings. The cathode is typically fabricated of iron, an iron alloy or some other metal, such as nickel, that is resistant to the corrosive conditions within the operating electrolytic cell environment to which the cathode is exposed, e.g., the corrosive conditions within the anolyte and catholyte compartments of an operating chlor-alkali electrolytic cell.

Electrolysis of alkali metal halide brines typically involves charging an aqueous solution of the alkali metal halide salt, e.g., sodium chloride, to the anolyte compartment of the cell. The alkali metal halide brine typically contains from 24 to 26 percent by weight of the alkali metal halide salt. The aqueous brine percolates through the liquid-permeable microporous diaphragm into the catholyte compartment and then is withdrawn from the cell. With the application of an electric potential across the anode and cathode of the cell, e.g., by the use of direct electric current, electrolysis of a portion of the percolating alkali metal halide occurs, and halogen gas, e.g., chlorine, is produced at the anode, while hydrogen gas is produced at the cathode. An aqueous solution of alkali metal hydroxide, e.g., sodium hydroxide, is produced in the catholyte compartment from the combination of alkali metal ions with hydroxyl ions. The resultant catholyte liquor, which comprises principally alkali metal hydroxide and depleted alkali metal halide brine, is withdrawn from the catholyte compartment. The alkali metal hydroxide product is subsequently separated from the catholyte liquor, and usually concentrated for sale commercially.

Historically, asbestos has been the most common diaphragm material used in chlor-alkali electrolytic diaphragm cells for the electrolysis of alkali metal halide brines because of its chemical resistance to the corrosive conditions that exist in such electrolytic cells. Asbestos in combination with various polymeric resins, particularly fluorocarbon resins (the so-called polymer- or resin-modified asbestos diaphragms), have been used also as diaphragm materials in such electrolytic cells. Due in part to possible health and safety issues associated with air-borne asbestos fibers resulting from the use of asbestos in other applications, synthetic diaphragms, e.g., non-asbestos-containing diaphragms, have been developed for use in chlor-alkali diaphragm electrolytic cells.

Synthetic microporous diaphragms are generally fabricated from fibrous polymeric materials that are at least substantially resistant to the corrosive conditions present within the electrolytic cell, such as a chlor-alkali cell, e.g., the corrosive environments found in the anolyte and catholyte compartments. Generally, the synthetic diaphragm is formed on a liquid-permeable substrate, e.g., a foraminous cathode, by vacuum depositing onto the substrate (in one or more steps) the materials comprising the diaphragm from an aqueous slurry of those materials.

In the case of chlor-alkali diaphragm electrolytic cells, synthetic diaphragms are prepared using fibrous organic polymers. Useful fibrous organic polymers include, but are not limited to, a polymer, copolymer, graft polymer or combinations of polymers that are at least substantially chemically resistant to the corrosive conditions in which the diaphragm is employed, e.g., chemically resistant to degradation by exposure to the reactants, products and co-products present in the anolyte and catholyte compartments. Such products and co-products include, but are not limited to, sodium hydroxide, chlorine and hydrochloric acid.

Typically, the fibrous organic polymers used to prepare synthetic diaphragms are halocarbon, i.e., halogen-containing, polymer fibers, particularly fluorocarbon polymer fibers. Non-limiting examples of halogen-containing polymer fibers include fluorine- and fluorine-/chlorine-containing polymers, such as perfluorinated polymers, and chlorine-containing polymers that include fluorine. Specific examples of such halogen-containing polymer and copolymer fibers include, but are not limited to, polymers, such as polyvinyl fluoride, polyvinylidene fluoride, polytetrafluoroethylene (PTFE), polyperfluoro(ethylene-propylene), polytrifluoroethylene, copolymers of trifluoroethylene and hexafluoropropylene, polyfluoroalkoxyethylene (PFA polymer), perfluoro(vinyl ethers), e.g., perfluoro(methyl vinyl ether), polychlorotrifluoroethylene (PCTFE polymer) and the copolymer of chlorotrifluoroethylene and ethylene (CTFE polymer). Typically, the synthetic diaphragm used in a chlor-alkali electrolytic cell is formed from a composition comprising polytetrafluoroethylene fibers.

Halocarbon polymer fibers, such as PTFE fibers, are well known to those skilled in the art and are commercially available. For example, PTFE fibers are currently available from TORAY Fluorofibers (America), Inc. under the trade names TEFLON and PTFE Fluoropolymer Fiber. Such fibers are available in a denier of from 1.75 to 6.7, and lengths of from 0.5 to 4 inches (1.3 to 10.2 cm.) Polytetrafluoroethylene (CAS 9002-84-0) fiber can be produced by emulsion spinning of the PTFE polymer. See, for example, Belgian Patent No. 795,724.

Halocarbon polymer short fibers such as PTFE polymer short fibers are commercially available from TORAY Fluorofibers (America) Inc. under the trade name PTFE Fluoropolymer Floc. Because of the methods used, the product, e.g., the short fiber, is not of uniform dimension. Typically, the length and diameter of the product are expressed as a mean or average value. A commercially available PTFE short fiber available from TORAY Fluorofibers (America) Inc is reported to have a mean length of between 0.01 and 0.02, e.g., 0.015, inches (0.025 and 0.051, e.g., 0.038, cm) and a denier of 6.6 or 6.7.

An important property of the synthetic diaphragm used in the electrolytic diaphragm cell is its ability to wick (wet) the electrolyte, e.g., the aqueous alkali metal halide solution, which percolates through the diaphragm. To provide the property of wettability, the synthetic diaphragm generally further comprises ion-exchange materials having cation selective groups thereon, e.g., acid groups. In a particular embodiment, the acid groups include, but are not limited to, sulfonic acid groups, carboxylic acid groups and their derivatives, e.g., esters, phosphonic acid groups, and phosphoric acid groups. Generally, the acid group is a sulfonic acid group and/or a carboxylic acid group.

In a particular aspect, the ion-exchange material is a perfluorinated copolymer material prepared from the polymerization of a fluorovinyl ether monomer containing a functional group, e.g., an ion-exchange group or a functional group easily converted into an ion-exchange group, and a monomer chosen from fluorovinyl compounds, such as vinyl fluoride, vinylidene fluoride, trifluoroethylene, tetrafluoroethylene, hexafluoroethylene, hexafluoropropylene, chlorotrifluoroethylene and perfluoro(alkylvinyl ether), with the alkyl moiety being an alkyl group containing from 1 to 10 carbon atoms. A description of such ion-exchange materials can be found in column 5, line 36 through column 6, line 2 of U.S. Pat. No. 4,680,101, which disclosure is incorporated herein by reference. Generally, an ion-exchange material with a sulfonic acid functionality is used. A perfluorosulfonic acid ion-exchange material (5 weight percent solution) is available from E. I. du Pont de Nemours and Company under the trade name NAFION. Other appropriate halogenated ion-exchange materials that can be used to allow the aqueous brine fed to the anolyte compartment to wet the diaphragm of the electrolytic cell include, for example, the ion-exchange material available from Asahi Glass Company, Ltd. under the trade name FLEMION, and the ion-exchange material available from Solvay under the trade name AQUIVION.

Organic halocarbon polymer materials in the form of microfibrils are also generally used to prepare synthetic diaphragms. Such microfibrils can be prepared in accordance with the method described in U.S. Pat. No. 5,030,403, the disclosure of such method being incorporated herein by reference. In accordance with the method described in that U.S. Patent, an aqueous suspension of commercially available PTFE powder, e.g., powder that has an average ultimate particle size of about 0.1 micron, is passed under high pressure (≥2000 psig [13.8 MPa]) through a two-stage homogenizing valve. Typically, the commercial PTFE powder comprises agglomerates of ultimate particles. The particle size distribution of the agglomerates can vary broadly, i.e., ranging from 100 to 1400 microns, but commonly the particle size distribution of the agglomerates range primarily from 300 to 700 microns, e.g., from 400 or 450 to 600 microns.

The halocarbon polymer fibers and microfibrils, e.g., PTFE fibers and PTFE microfibrils, generally comprise the predominant portion of the diaphragm halocarbon polymer fiber solids. As the ion-exchange material is often more costly than the halocarbon polymer fibers and microfibrils, the diaphragm generally comprises from 65 to 93 percent by weight combined of such fibers and microfibrils and from 0.5 to 2 percent by weight of the ion-exchange material.

The halocarbon polymer fiber used to prepare a synthetic chlor-alkali diaphragm is well known in the art. Typically, the halocarbon polymer fiber has a mean fiber length of between at least 0.15 inch (0.38 cm) and 0.75 inch (1.91 cm), and a mean diameter of approximately 20 microns. Polymer fibers comprising the diaphragm can be of any suitable denier, e.g., commercially available fibers. In one aspect, the typical halocarbon polymer fiber, e.g., PTFE fiber, used to prepare synthetic diaphragm is reported to be approximately a 0.25 to 0.27 inch (0.64 to 0.69 cm) diameter, chopped 6.6 or 6.7 denier fiber; however, fibers of a smaller denier can be used. The appearance of these fibers is similar to ribbon cable.

In addition to the aforedescribed halocarbon polymer fiber, halocarbon polymer microfibril and ion-exchange material, the liquid slurry used to deposit the synthetic diaphragm on the foraminous cathode can also include other materials. Such other materials include, but are not limited to, materials such as thickeners, surfactants, antifoaming agents, antimicrobial agents and other hydrocarbon polymers, e.g., a polyolefin such as polyethylene. Further, materials such as fiberglass can also be incorporated into the diaphragm. A non-limiting example of the components of a synthetic diaphragm material useful in a chlor-alkali electrolytic cell can be found in Example 1 of U.S. Pat. No. 5,188,712, the disclosure of which synthetic diaphragm composition is incorporated herein by reference.

Synthetic diaphragms can also comprise various modifiers and additives, including but not limited to, inorganic fillers, such as clays, metal oxides, pore formers, wetting agents, etc, as is well known in the art. Synthetic diaphragms can comprise one or more layers of modifiers and additives that are deposited on and within the interstices of the diaphragm comprising the various fibrous halogen-containing polymers, e.g., one or more top coats of vacuum deposited modifiers and additives, as is known to those skilled in the art.

The diaphragm of an electrolytic cell, e.g., a chlor-alkali electrolytic cell, is typically deposited onto the foraminous cathode from a slurry of components comprising the base coat of the diaphragm. In one aspect, the slurry comprises an aqueous liquid medium such as water. Such an aqueous slurry generally comprises from 1 to 6 weight percent solids, e.g., from 1.5 to 3.5 weight percent solids, of the diaphragm base coat components, and has a pH of between 8 and 12.5. The appropriate pH can be obtained by the addition of an alkaline reagent, such as alkali metal hydroxide, e.g., sodium hydroxide, to the slurry.

The amount of each of the components comprising the synthetic diaphragm can vary in accordance with variations known to those skilled in the art. In one aspect, the following approximate amounts (as a percentage by weight of the total slurry having a percent solids of between 1 and 6 weight percent) of the diaphragm components in a slurry used to deposit a synthetic diaphragm can be used: polyfluorocarbon fibers, e.g., PTFE fibers, —from 0.25 to 1.5 percent; polyfluorocarbon microfibril, e.g., PTFE microfibril, —from 0.6 to 3.8 percent; ion-exchange material, e.g., NAFION resin, —from 0.01 to 0.05 percent; fiberglass—from 0.0 to 0.4 percent; and polyolefin, e.g., polyethylene, such as SHORT STUFF, —from 0.06 to 0.3 percent.

The aqueous slurry comprising the synthetic diaphragm components can also contain a viscosity modifier or thickening agent to assist in the dispersion of the solids, e.g., the perfluorinated polymeric materials, in the slurry. For example, a thickening agent such as CELLOSIZE® can be used. In a particular aspect, from 0.1 to 5 percent by weight of thickening agent can be added to the slurry mixture, basis the total weight of the slurry. In an alternate aspect, from 0.1 to 2 percent by weight thickening agent can be used.

A surfactant may, if desired, be added to the aqueous slurry of synthetic diaphragm components to assist in obtaining an appropriate dispersion. In one aspect, the surfactant is a nonionic surfactant and is used in amounts of from 0.1 to 3 percent, e.g., from 0.1 to 1 percent, by weight, based on the total weight of the slurry. In a particular aspect, the nonionic surfactant is a chloride capped ethoxylated aliphatic alcohol, wherein the hydrophobic portion of the surfactant is a hydrocarbon group containing from 8 to 15, e.g., 12 to 15, carbon atoms, and the average number of ethoxylate groups ranges from 5 to 15, e.g., 9 to 10. A non-limiting example of such a nonionic surfactant is AVANEL® N-925 surfactant.

Other additives that can be incorporated into the aqueous slurry of synthetic diaphragm forming components include, but are not limited to, antifoaming amounts of an antifoaming agent, such as UCON® LO-500 antifoaming compound, to prevent the generation of excessive foam during mixing of the slurry, and an antimicrobial agent to prevent the digestion of cellulose-based components by microbes during storage of the slurry. A non-limiting example of an antimicrobial agent is UCARCIDE® 50, which is available from the Dow Chemical Company. Other antimicrobial agents known to those skilled in the art also can be used. Generally, antimicrobials are incorporated into the aqueous slurry of synthetic diaphragm components in amounts of from 0.05 to 0.5 percent by weight, e.g., between 0.08 and 0.2 weight percent.

The diaphragm of an electrolytic cell, e.g., a chlor-alkali electrolytic cell, is liquid-permeable, thereby allowing an electrolyte, such as sodium chloride brine, which is subject to a pressure gradient to pass through the diaphragm. Generally, the pressure gradient in a diaphragm electrolytic cell is the result of a hydrostatic head on the anolyte side of the cell, e.g., the liquid level in the anolyte compartment will be on the order of from 1 to 25 inches (2.54-63.5 cm) higher than the liquid level of the catholyte compartment. The specific flow rate of electrolyte through the diaphragm can vary with the type of the cell, and how it is used. In a chlor-alkali cell, the diaphragm is microporous and is prepared in such a manner that it is able to pass from 0.01 to 0.5, e.g., 0.01 to 0.05, cubic centimeters of anolyte per minute per square centimeter of diaphragm surface area. The flow rate is generally set at a rate that allows production of a predetermined, targeted concentration of the principal product formed in the catholyte compartment. In a chlor-alkali electrolytic cell, the principal product formed in the catholyte compartment is alkali metal hydroxide, e.g., sodium hydroxide. Generally, synthetic diaphragms used in chlor-alkali cells, will have a porosity (permeability) similar to that of asbestos-type and polymer resin modified asbestos diaphragms.

The thickness of the diaphragm used in electrolytic cells can vary and will depend on the type of electrolytic cell used and the nature of the electrochemical process being performed. In the case of chlor-alkali electrolytic cells, diaphragms, e.g., synthetic diaphragms, generally have a thickness of from 0.075 to 0.25 inches (0.19 to 0.64 cm), and a weight per unit area ranging from 0.3 to 0.6 pounds per square foot (1.5 to 2.9 kilograms per square meter) of the cathode.

It is common to apply (usually by vacuum deposition) one or more coatings of water-insoluble, inorganic particulate material on top of and within the interstices of the diaphragm, e.g., the synthetic diaphragm, to control the microporosity of the diaphragm. Details of such coatings and the methods used to form such coatings can be found in U.S. Pat. Nos. 4,869,793, 5,612,089, 5,683,749, 6,059,944 and 6,299,939 B1. Such coating(s) are generally referred to as topcoats and are generally deposited on the diaphragm by drawing an aqueous slurry comprising the inorganic particulate material through the previously formed diaphragm (base coat) by use of a vacuum.

As described in column 2, line 65 through column 6, line 65 of U.S. Pat. No. 6,299,939 B1 patent, which disclosure is incorporated herein by reference, the inorganic particulate material present in the top coat slurry may be selected from (i) oxides, borides, carbides, silicates and nitrides of valve metals, (ii) clay mineral, and (iii) mixtures of (i) and (ii). Typically, the inorganic particulate material is substantially water-insoluble. The term "valve metal" includes the metals vanadium, chromium, zirconium, niobium, molybdenum, hafnium, tantalum, titanium, tungsten and mixtures of such metals. Of the previously described valve metals, the described compounds of titanium and zirconium are generally the valve metal materials used. Of the valve metal oxides, borides, carbides and silicates, valve metal oxides and silicates are the materials typically used. Non-limiting examples of valve metal oxides include titanium oxide and zirconium oxide. In addition, alkaline earth oxides and hydroxides, e.g., magnesium hydroxide, may be present in the top coat slurry and in the top coat applied to the surface of the diaphragm.

Non-limiting examples of clay minerals that may be present in the topcoat slurry include the naturally occurring hydrated silicates of metals, such as aluminum and magnesium, e.g., kaolin, meerschaums, augite, talc, vermiculite, wollastonite, montmorillonite, illite, glauconite, attapulgite, sepiolite and hectorite. Of the aforementioned clay minerals, attapulgite and hectorite and mixtures of such clays are typically used. Such clays are hydrated magnesium silicates and magnesium aluminum silicates, which materials may also be prepared synthetically. Attapulgite clay is available commercially from BASF Corporation under the trade name ATTAGEL.

The mean particle size of the inorganic particulate material used in the topcoat slurry or as a dopant material can vary. In one non-limiting embodiment, the mean particle size may range from 0.1 to 20 microns, e.g., from 0.1 to 0.5 microns. For example, one particular commercially available attapulgite clay has a mean particle size of 0.1 microns.

The amount of inorganic particulate material in the topcoat slurry can vary and will depend on the amount that is required for the particular diaphragm. In one non-limiting embodiment, the topcoat slurry can contain from 1 to 15 grams per liter (gpl) of inorganic particulate material. In alternate non-limiting embodiments, the amount of inorganic particulate in the topcoat slurry may vary from 5 to 15 gpl, e.g., 8 to 12 gpl.

The topcoat slurry may also comprise alkali metal polyphosphate, e.g., sodium polyphosphate, potassium polyphosphate and mixtures of such polyphosphates. The polyphosphate may be a hydrated polyphosphate, a dehydrated polyphosphate or a mixture of hydrated and dehydrated polyphosphates. In one aspect, the alkali metal polyphosphate may be present in the topcoat slurry in an amount of at least 0.01 weight percent. Alternatively, the alkali metal polyphosphate may be present in amounts of at least 0.1 weight percent. Generally, the alkali metal polyphosphate is present in the topcoat slurry in amounts of less than 2 weight percent. In a further aspect, the alkali metal polyphosphate is present in the topcoat slurry in amounts of less than 1 weight percent, e.g., less than 0.5 weight percent. The amount of alkali metal polyphosphate present in the topcoat slurry can range between any of the aforedescribed upper and lower values, inclusive of the recited values.

Non-limiting examples of alkali metal polyphosphates include tetraalkali metal pyrophosphate, e.g., tetra sodium pyrophosphate and tetra potassium pyrophosphate, alkali metal triphosphate, e.g., sodium triphosphate and potassium triphosphate, alkali metal tetraphosphate, e.g., sodium tetraphosphate, alkali metal hexametaphosphate, e.g., sodium hexametaphosphate, and mixtures of such polyphosphates.

During operation of a diaphragm electrolytic cell, i.e., during electrolysis of the electrolyte charged to the anolyte compartment, e.g., alkali metal halide brine, perforations may occur in the diaphragm, e.g., tears, holes, or thinning of the diaphragm can develop in or on the diaphragm surface. Such perforations create pores that are larger than the pores that are present in the microporous diaphragm during normal operation of the electrolytic cell, e.g., the pores that define the microporosity of the diaphragm. The root cause of such perforation(s) is not known for certain. However, as a result of such perforation(s), the catholyte in the catholyte compartment can be diluted with electrolyte due to the increase in the flow of electrolyte from the anolyte compartment through the diaphragm into catholyte compartment if the driving force (hydrostatic head) on the electrolyte in the anolyte compartment remains constant. The dilution effect is evidenced, for example, by a decrease in the concentration of the principal product formed in the catholyte compartment.

As noted, anolyte flow through the diaphragm is a function of resistance to flow (the diaphragm) and the driving force (hydrostatic head) on the anolyte liquid. If there are perforation(s) in the diaphragm, the resistance to anolyte flow through the diaphragm will be reduced and therefore the flow through the diaphragm will increase provided that the hydrostatic head remains constant. In many cases, particularly in the case of monopolar cells, the hydrostatic head will be reduced, e.g., by reducing the flow of brine to the anolyte compartment, in order to attempt to increase the concentration of alkali metal hydroxide (and/or decrease the level of hypochlorite ion) in the catholyte compartment. Anolyte (brine) flow through the diaphragm can also be expressed as the rate of flow through the diaphragm per unit of hydrostatic head differential.

In the case of a chlor-alkali electrolytic cell, e.g., a cell in which alkali metal chloride, e.g., sodium chloride, is electrolyzed, the concentration of the aqueous alkali metal hydroxide in the catholyte liquor, e.g., sodium hydroxide, can decrease as a result of the dilution effect. In one aspect, the decrease in the concentration of the aqueous alkali metal hydroxide that is observed as a result of perforations occurring in the diaphragm can be 2 percent or more. Sometimes the observed decrease in alkali metal hydroxide in the catholyte liquor as a result of perforations in the diaphragm can be as much as from 3 to 70 percent, e.g., from 3 to 40 percent. Under conventional good operating conditions of the electrolyzer, the desired alkali metal hydroxide concentration, e.g., the concentration of sodium hydroxide, in the catholyte compartment will typically be in the range of from approximately 130 to 155 grams per liter (gpl), although higher and lower concentrations can be observed.

The concentration of alkali metal hydroxide in the catholyte liquor will vary and depend on the particular operating conditions of the cell, e.g., the current load, the current efficiency of the electrolyzer, the rate of flow of anolyte through the diaphragm, etc. Periodic chemical analysis of the catholyte liquor withdrawn from the catholyte compartment will evidence a decrease in the alkali metal hydroxide concentration and indicate that there are possible perforations in the diaphragm. An aqueous alkali metal hydroxide solution product of diminished concentration results in increased process costs in order to evaporate the excess water present in the alkali metal hydroxide recovered from the catholyte liquor in order to bring the alkali metal hydroxide solution to concentrations that are sold commercially.

Further, in the case of the electrolysis of an aqueous alkali metal halide solution, e.g., sodium chloride solutions, an increase in the concentration of hypohalite e.g., hypochlorite ion, as alkali metal hypohalite may also be observed in the catholyte liquor as a consequence of increased anolyte flow through the diaphragm. Generally, the concentration of hypohalite ion in the catholyte liquor of a good operating chlor-alkali electrolytic cell will range from 0 to 10 parts per million (ppm), e.g., 3 to 10 ppm. When perforations occur in the diaphragm, the hypohalite ion concentration in the catholyte liquor can increase to levels of 150 ppm or more. In the case of monopolar chlor-alkali electrolytic cells, hypohalite ion concentrations of 500+ ppm have been observed. Chemical analysis of the catholyte liquor removed from the catholyte will provide the hypohalite concentration present therein (as alkali metal hypohalite such as sodium hypochlorite) and is further indicative of perforation(s) being present in the diaphragm. In one aspect, the concentration of hypohalite ion in the catholyte liquor as a result of perforation(s) in the diaphragm can range from 20 to 150 ppm. In certain circumstances, the increase in hypohalite concentration in the catholyte liquor as a result of perforation(s) in the diaphragm can range from 25 to 100 ppm, e.g., 25 to 50 ppm. The increase in hypohalite concentration in the catholyte liquor can range between any combinations of the described concentrations, inclusive of the recited concentrations. The increase in hypohalite concentration in the catholyte liquor may be independent of the decrease of the alkali metal hydroxide concentration in the catholyte liquor because of alternative efforts to increase the alkali metal hydroxide concentration, e.g., by reducing the flow of brine to the anolyte compartment.

The presence of hypohalite ion within the electrolytic cell can cause corrosion of the steel cathode and cell substrate, thereby reducing the life of the cell components. Such corrosion can also result in the production of a source of iron that can be trapped in the diaphragm and ultimately form an active cathode in the anolyte compartment. This can lead to the formation of hydrogen in the anolyte compartment, which will contaminate the halogen, e.g., chlorine, product formed in that compartment, pose a potential safety issue, and limit the usable lifetime of the diaphragm. Moreover, the presence of hypohalite, e.g., hypochlorite, in the catholyte liquor can cause corrosion of downstream equipment and consume materials added to reduce oxidizing contaminants in evaporative equipment used downstream to concentrate the catholyte product, i.e., alkali metal hydroxide, e.g., sodium hydroxide, in the case of the electrolysis of alkali metal chloride brines such as sodium chloride solutions.

In accordance with a non-limiting aspect of the present invention, particulate material comprising halocarbon polymer short fiber, e.g., fluorocarbon polymer short fiber such as PTFE short fiber, is introduced into the anolyte compartment of a diaphragm electrolytic cell, e.g., a chlor-alkali diaphragm electrolytic cell, in amounts sufficient to reduce the flow of liquid anolyte (electrolyte) through the diaphragm into the catholyte compartment, e.g., an effective amount. In an alternate non-limiting aspect of the present invention, halocarbon polymer short fiber is introduced into the anolyte compartment in amounts sufficient to reduce the flow of anolyte (electrolyte) through the diaphragm to a value within the desired operating range chosen for the treated cell. In the case of a chlor-alkali cell, the flow rate of anolyte through the diaphragm is typically within the range of from 0.001 to 0.5 cubic centimeters per minute per square centimeter of effective diaphragm surface area. In accordance with a particular aspect of the present invention, halocarbon polymer short fiber is introduced into the anolyte compartment while the cell is operating.

In a particular aspect of the present invention and in the case of chlor-alkali electrolytic cells, the amount of particulate material comprising halocarbon polymer short fiber introduced into the anolyte compartment is an amount sufficient to increase the concentration of alkali metal hydroxide, e.g., sodium hydroxide, in the catholyte liquor, i.e., an effective amount when alternate methods of reducing the flow of anolyte liquor through the diaphragm are not employed or are not successful. In an alternate non-limiting aspect of the present invention, the amount of particulate material comprising halocarbon polymer short fiber introduced into the anolyte compartment is an amount sufficient to reduce the concentration of hypohalite ion, e.g., hypochlorite ion (measured as sodium hypochlorite) in the catholyte liquor, i.e., an effective amount. In a particular non-limiting aspect, the increase in alkali metal hydroxide concentration and the decrease in hypohalite ion concentration in the catholyte liquor are to values at least substantially the same as the respective concentrations of such materials that existed in the catholyte liquor prior to the conditions that gave rise to the need for adding the halocarbon polymer short fiber to the anolyte compartment. In a further aspect, the increase in alkali metal hydroxide concentration and decrease in hypohalite ion concentration are those respective concentrations that are within the range established for a good operating electrolytic cell, e.g., standard operating conditions for a cell of the type treated.

In one aspect of the present invention, particulate material comprising halocarbon polymer short fiber, i.e., dopant material, is introduced batchwise into the anolyte compartment. Alternatively, the particulate material comprising halocarbon polymer short fiber may be introduced continuously into the anolyte compartment. Regardless of the manner by which particulate material comprising halocarbon polymer short fiber is introduced into the anolyte compartment, e.g., periodically or continuously, the particulate dopant material can in alternate non-limiting embodiments be introduced therein as a dry material, as a wetted fiber or in the form of a slurry, e.g., an aqueous slurry. In the case of an aqueous slurry, the aqueous portion of the slurry can be, but is not limited to, water, anolyte feed, e.g., brine, recycled anolyte liquor, or mixtures of such aqueous liquids. Generally, water or brine feed is used to prepare the slurry. Typically, the particulate dopant material is introduced periodically, e.g., batchwise, as an aqueous slurry into the anolyte compartment as needed, i.e., in response to observed changes in cell operation. Additionally, the particulate dopant material can be introduced directly into the anolyte compartment or added to a brine containment vessel from which brine is forwarded directly to the anolyte compartment.

Further, surfactant, e.g., a nonionic surfactant such as the AVANEL N-925 surfactant described previously, can be mixed with the particulate dopant material slurry in order to provide an improved dispersion of the particulates in the slurry, thereby resulting in a more uniform addition of particulates to the anolyte compartment. The amount of surfactant added to the particulate dopant slurry is that amount that is sufficient to provide a satisfactory dispersion of the particulates in the liquid portion of the slurry for the time frame during which the slurry is introduced into the anolyte compartment.

In one aspect of the present invention, particulate material comprising halocarbon polymer short fiber is introduced into the anolyte compartment (continuously, intermittently, or batchwise) until the concentration of principal product in the catholyte liquor, e.g., alkali metal hydroxide, returns to the desired level. In the case of a chlor-alkali cell, particulate dopant material comprising halocarbon polymer short fiber is introduced into the anolyte compartment until (1) the concentration of alkali metal hydroxide returns to a desired level, and/or (2) the hypohalite ion concentration returns to a desired level. Chemical analysis of the catholyte liquor subsequent to the initial introduction of the particulate dopant material to the anolyte compartment and after equilibrium within the cell is substantially attained will determine if sufficient particulate dopant material has been introduced to bring the cell back to its desired operating conditions, or whether additional amounts of particulate dopant material are required to rectify the increased flow of anolyte through the diaphragm. Such chemical analyses are good indicators of whether the flow of anolyte liquor through the diaphragm is excessive or whether it is within the range of standard cell operating conditions. Periodic chemical analysis of the catholyte liquor after addition of particulate dopant material comprising short fibers avoids producing an operating condition wherein the flow of anolyte liquor through the diaphragm becomes too low. The sequential steps of catholyte liquor analysis and particulate dopant material addition to the anolyte compartment can be repeated until the cell returns to a desired operating condition.

The amount of halocarbon polymer short fiber introduced into the anolyte compartment can vary. In one aspect of the present invention, the amount of short fiber charged to the anolyte compartment during each occurrence of short fiber addition can range from 0.001 to 0.01 pounds of short fiber per square foot (5 grams/square meter to 50 grams/square meter) of effective diaphragm surface area (the surface area through which electrolyte passes into the catholyte compartment). In a further aspect of the present invention, the amount of short fiber introduced into the anolyte compartment can range from 0.002 to 0.007 pounds/ft$^2$ (10 g/m$^2$ to 35.5 g/m$^2$) of effective diaphragm surface area, e.g., from 0.002 to 0.005 pounds/ft$^2$ (10 g/m$^2$ to 25.6 g/m$^2$) of effective diaphragm surface area. The amount of short fiber introduced into the anolyte compartment can vary between any combinations of the stated values, including the recited amounts. Care should be observed that the amount of short fiber added to the anolyte is not excessive, thereby resulting in either plugging of the diaphragm or reducing the flow of electrolyte through the diaphragm to rates significantly below that of normal operating conditions.

The halocarbon polymer short fiber is at least partially resistant to the corrosive conditions within the anolyte of the electrolytic cell, e.g., oxidizing conditions, pH and temperature. For example, in a chlor-alkali electrolytic cell, the pH of the anolyte is generally acidic. Corrosive conditions within the anolyte compartment of the chlor-alkali cell can be caused by the presence of chlorine, hydrochloric acid, hypochlorous acid, chlorate ions and oxygen within the anolyte compartment. Further, it is possible for the halocarbon polymer short fibers to be exposed to alkaline materials, e.g., hydroxides, which are present on or in the diaphragm or that back migrate from the catholyte department, which may also cause chemical degradation of the short fibers. In addition, the halocarbon polymer short fibers may be eroded by mechanical forces operating within the anolyte compartment. In such an event, perforations in the diaphragm are likely to reoccur. Generally, the perforations will reoccur gradually, as evidenced for example by the decrease in concentration of alkali metal hydroxide product within the catholyte compartment. In such an event, the addition of further quantities of short fiber to the anolyte compartment may be required.

The halocarbon polymer short fiber material introduced into the anolyte compartment, e.g., fluorocarbon polymer short fiber (such as PTFE short fiber floe), is at least partially resistant to degradation by the chemical and mechanical forces within the anolyte compartment for a reasonable period of time. The period of time that the short fibers perform their function of reducing the flow of anolyte into the catholyte compartment (as a result of perforations in the diaphragm) can vary, and will be a function of the particular short fiber used, the conditions within the electrolytic cell, e.g., turbulence, power (load) variations, outages and the previously described chemically corrosive conditions. In one aspect, the electrolytic cell will operate at substantially the standard operating conditions for that particular cell after the addition of particulate dopant material comprising halocarbon polymer short fiber to mend perforations in the diaphragm (and after equilibrium is substantially attained) for from approximately 2 to 12 weeks or longer, although shorter periods of time can be expected in some cases while longer periods of time also have been observed.

Other dopant materials can be introduced into the anolyte compartment in conjunction with the halocarbon polymer short fiber material. In a non-limiting aspect of the present invention, at least one other dopant material is added to the anolyte compartment at substantially the same time as the short fiber material. In an alternate non-limiting aspect of the present invention, the other dopant material(s) is added before or subsequent to, e.g., sequentially, to the addition of the short fiber material. In a further non-limiting aspect of the present invention, the other dopant material(s) is added to the anolyte compartment mixed with the short fiber, e.g., as an aqueous or aqueous brine slurry.

In a further aspect of the present invention, fibers comprising halocarbon polymers, e.g., fluorocarbon polymers, which are of a different length, e.g., longer, than the halocarbon polymer short fiber, i.e., the halocarbon polymer fiber used to prepare the diaphragm, can be added to the anolyte compartment of the electrolytic cell in conjunction with the short fiber material, e.g., at substantially the same time as the short fiber material, to complement the addition of short fibers. Alternatively, the complementary fibers comprising halocarbon polymers can be added before or subsequent to, e.g., sequentially, the addition of the short fiber material to the anolyte compartment. In another aspect of the present invention, particulate dopant material other than short fiber material and complementary fibers of halocarbon polymer, e.g., fibers of fluorocarbon polymer can be added to the anolyte compartment of the electrolytic cell to work in conjunction with the halocarbon short fiber material.

In another aspect of the present invention, microfibrils of halocarbon polymers, e.g., fluorine-containing polymer fibers, such as PTFE microfibril fibers, can be added as a dopant material to the anolyte compartment in conjunction with the addition of short fibers to repair perforations in the diaphragm. The amount of such microfibril fibers and the other complementary halogen-containing polymer fibers added to the anolyte compartment as dopant material will be in amounts similar to that used for the short fibers, e.g., from 0.001 to 0.01 pounds/ft$^2$ (5 g/m$^2$ to 50 g/m$^2$) of effective diaphragm surface area, such as from 0.002 to 0.005 pounds/ft$^2$ (10 g/m$^2$ to 25.6 g/m$^2$) of effective diaphragm surface area. When halocarbon polymer microfibrils are used in combination with halocarbon polymer short fibers, the weight ratio of short fibers to microfibrils added to the anolyte compartment can range from 0.3:1 to 3:1, e.g., from 0.4:1 to 1.5:1 such as from 0.5:1 to 1.2:1.

In another aspect of the present invention, clay mineral and/or alkaline earth metal oxides and/or hydroxides (oxides/hydroxides) can be added as dopant material to the anolyte compartment of the electrolytic cell in conjunction with the halocarbon polymer short fibers. Zirconium oxide/hydroxide may also be used as a dopant material. As with the halocarbon polymer fibers, e.g., microfibrils, (other than the short fibers) that are introduced as dopant material into the anolyte compartment of the electrolytic cell, clay mineral and/or the aforedescribed metal oxides/hydroxides can be added before, after or together with the halocarbon polymer short fibers, e.g., mixed with the particulate short fibers in an aqueous, e.g., brine, slurry.

Examples of clay minerals include, but are not limited to, the hydrated magnesium silicates and magnesium aluminum silicates, such as kaolin, talc, vermiculite, montmorillonite, attapulgite, sepiolite, and hectorite clay minerals, and mixtures of such materials. An example of an alkaline earth metal oxide/hydroxide includes, but is not limited to, magnesium oxide and magnesium hydroxide. Generally, clay minerals and oxide/hydroxide materials such as magnesium hydroxide and zirconium hydroxide are commercially available. The mean particle size of clay mineral that can be used as a particulate dopant material can vary. In one non-limiting embodiment, the mean particle size of clay mineral may range from 0.1 to 20 microns, e.g., from 0.1 to 0.5 microns.

For example, a commercially available attapulgite clay typically used has a mean particle size of 0.1 microns.

The amount of each of clay mineral and alkaline earth metal oxide/hydroxide that can be added to the anolyte compartment as a dopant material can vary. Generally, from 0.0025 to 0.015 lb/ft$^2$ (12.2 to 75 g/m$^2$) of effective diaphragm surface area, e.g., from 0.0035 to 0.012 lb/ft$^2$ (17.8 to 60 g/m$^2$) of each of such materials can be added. The clay mineral dopant can be used alone or in combination with the alkaline metal oxide/hydroxide when added to the anolyte compartment with the halocarbon polymer short fibers.

The order in which the halocarbon polymer short fiber material, halocarbon polymer microfibrils, longer halogen-containing polymer fibers, e.g., fibrous PTFE, and/or other dopant material such as clay mineral and alkaline earth metal oxide/hydroxide are added to the anolyte compartment can vary. Generally, for reasons of convenience, the particulate dopant material is prepared as an aqueous slurry, e.g., an aqueous brine slurry, and the slurry added to the anolyte compartment while the cell is operating. The dopant slurry can comprise a mixture of two, three or more of the aforementioned materials.

In summary, described is a method for improving the operation of a diaphragm electrolytic cell that exhibits an undesired increase flow of electrolyte (anolyte liquor) through the diaphragm as a result of perforations in the diaphragm. The method described herein comprises introducing particulate dopant material comprising short fibers of halocarbon polymer into the anolyte compartment in amounts sufficient to reduce the flow of liquid anolyte through the diaphragm into the catholyte compartment. Generally, the halocarbon polymer short fiber is introduced into the anolyte compartment while the cell is operating, e.g., during electrolysis. In another aspect, the halocarbon polymer short fiber is introduced into the anolyte compartment when the electrolytic cell is off line, i.e., when no electric field, e.g., current, is applied to the electrodes of the cell. In a further aspect of the present invention, other dopant materials such as halogen-containing polymer fibers, e.g., fluorocarbon fibers of a different length (typically longer) than the halocarbon polymer short fibers, clay mineral, zirconium oxide/hydroxide, alkaline earth metal oxide/hydroxide and mixtures of such dopant materials can be introduced into the anolyte compartment in conjunction with the halocarbon polymer short fibers.

The present invention is more particularly described in the following examples, which are intended as illustrative only, since numerous modifications and variations therein will be apparent to those skilled in the art.

In the following examples, the reported efficiencies of the chlor-alkali electrolytic cells are Oxy '6' efficiencies. These efficiencies are calculated using the following equation:

$$Oxy\ \text{'6'}\ \text{Efficiency} = \frac{\text{Volume \% } Cl_2}{\left[\begin{array}{c}(\text{Vol \% } Cl_2 + 2*(\text{Vol \% } O_2)) + \\ \dfrac{[6*gpl\ NaClO_3]*\text{Vol \% } Cl_2}{gpl\ NaOH}\end{array}\right]}$$

wherein:

Vol % $Cl_2$ is the cell gas (air-free) % chlorine by volume,

Vol % $O_2$ is the cell gas (air free) % oxygen by volume, gpl $NaClO_3$ is the sodium chlorate concentration in grams per liter in the catholyte cell liquor, and gpl NaOH is the sodium hydroxide concentration in grams per liter in the catholyte cell liquor.

The Oxy '6' equation assumes a constant ratio of sodium chlorate in the anolyte to that in the catholyte. The * in the equation represents the times (multiplication) operator.

Commercial scale bipolar electrolyzers were used in the following examples. The electrolyzers of Examples 1-2 had 12 elements per electrolyzer; while the electrolyzers of Examples 3-5 had 11 or 12 elements. Each electrolyzer element in Examples 1-2 contained 44 substantially vertical cathode fingers interleaved within and spaced from substantially vertical anodes; while each electrolyzer element in Examples 3-5 had 44 or 61 substantially vertical cathode fingers interleaved within and spaced from substantially vertical anodes. The cathode area for each element in Examples 1-2 was 416 square feet (33.6 square meters); while the cathode area for the electrolyzer elements in Examples 3-5 were 416 ft$^2$ (33.6 m$^2$) or 598 ft$^2$ (55.5 in$^2$).

The cathode fingers were provided with a non-asbestos synthetic diaphragm comprising fibrous polytetrafluoroethylene (PTFE), PTFE microfibers (microfibrils), NAFION® ion exchange material having sulfonic acid functional groups, fiberglass and SHORT STUFF polyethylene fibers. The synthetic diaphragms were deposited onto the cathodes by vacuum deposition from an aqueous slurry of the materials comprising the diaphragm. The synthetic diaphragms were coated (by vacuum deposition from an aqueous slurry) with inorganic particulate material. Depending on the electrolyzer element, the coating comprised either ATTAGEL® attapulgite clay and zirconium dioxide, or ATTAGEL® attapulgite clay, zirconium dioxide and magnesium hydroxide The bipolar electrolyzers were used for the electrolysis of sodium chloride brine. The concentration of the brine fed to the anolyte compartment of each electrolyzer element was in the range of 318 to 322 grams per liter (gpl). The voltage applied to each electrolyzer element in Examples 1-2 was in the range of 3.32 to 3.36 volts; while the voltage applied to each electrolyzer element in Examples 3-5 was in the range of 3.15 to 3.36 volts. The amperage applied to each electrolyzer element (unless noted otherwise) in Examples 1-2 varied from approximately 68 to 72 kilo amperes; while the voltage applied to each electrolyzer element in Examples 3-5 was 68 to 84 kilo amperes. During steady state operation, analysis of the catholyte liquor was performed at approximately seven-day intervals. The reported Oxy '6' efficiencies are for the electrolyzer.

Example 1

Analysis of the catholyte liquor from element No. 1 in a bipolar fingered chlor-alkali electrolyzer reported a sodium hydroxide (NaOH) concentration of 109.8 grams per liter (gpl), and a hypochlorite ion concentration, as sodium hypochlorite (NaOCl), of 28.5 parts per million (ppm). The Oxy '6' efficiency of the electrolyzer at this time was calculated to be 93%. In the week prior to the foregoing analysis the concentration of sodium hydroxide (NaOH) was approximately 128.3 gpl, and the sodium hypochlorite ion concentration was approximately 6.25 parts per million (ppm). These analyses indicated that perforations had developed in this element.

A doping solution comprising 5 pounds (2.27 kg) of Zeeosphere™ G-800 ceramic spheres (Zeeosphere Ceramics, LLC) and 5 pounds (2.27 kg) of ATTAGEL® 36 attapulgite clay (BASF Corporation) in 10 gallons (37.8 liters) of water was prepared and added to the element brine box from where it was introduced into the anolyte compartment of the electrolyzer element. Four days later, analysis of the catholyte liquor showed that the NaOH concentration was 108.7 gpl and the NaOCl concentration was 12.58 ppm. The Oxy '6' efficiency of the electrolyzer at this time was calculated to be 91.7%.

Approximately 3½ months later, analysis of the catholyte liquor from element 1 showed that the concentration of NaOH and NaCl was 79.3 gpl and 23.2 ppm. This time, a doping solution of 2 pounds (0.91 kg) of polytetrafluoroethylene (PTFE) short floc fibers, 2 gallons (7.57 liters) of PTFE microfibrils (10 wt. % solids), 10 gallons (37.8 liters) of water and approximately 0.1 gallon (0.38 liters) of AVANEL N-925 nonionic surfactant was added to the element brine box. Three days later, the concentrations of NaOH and NaOCl were 154.19 gpl and 0.32 ppm respectively. The Oxy '6' efficiency of the electrolyzer at this time was calculated to be 93.5%.

Example 2

Analysis of the catholyte liquor from element No. 1 of a bipolar fingered chlor-alkali electrolyzes from a different circuit than that of Example 1 showed a sodium hydroxide (NaOH) concentration of 154 gpl, and a hypochlorite ion concentration (as sodium hypochlorite-NaOCl) of 24.3 parts per million (ppm). The Oxy '6' efficiency of the electrolyzer at this time was calculated to be 91.2%.

A doping solution of 1 pound (0.45 kg) of polytetrafluoroethylene (PTFE) short floc fibers, 2 gallons (7.57 liters) of PTFE microfibrils (10 wt. % solids), and 10 gallons (37.8 liters) of water was prepared and added five days later to the brine box of element 1 from where it was introduced into the anolyte compartment of the electrolyzer element. Ten days later, analysis of the catholyte liquor showed that the NaOH concentration to be 150.9 gpl and the NaOCl concentration to be 10.3 ppm. The Oxy '6' efficiency of the electrolyzer at this time was calculated to be 87.4%. A week later, analysis of the catholyte liquor showed that the NaOH concentration to be approximately 151 gpl and the NaOCl concentration to be 1.26 ppm. The Oxy '6' efficiency of the electrolyzer at this time was calculated to be 93.9%.

Subsequently (about 7 weeks later) during which there was a reduction in the load (kA) to the electrolyzer, analysis of the catholyte liquor showed the NaOH concentration to be 118.1 gpl and the NaOCl concentration to be 12.5 ppm. A reduction in load to the electrolyzer results in less flow through the diaphragm and tends to produce an increase in the NaOCl concentration. The Oxy '6' efficiency of the electrolyzer at this time was calculated to be 91.5%.

A doping solution of 1 pound (0.45 kg) of polytetrafluoroethylene (PTFE) short floc fibers, 2 gallons (7.57 liters) of PTFE microfibrils (10 wt. % solids), and 10 gallons (37.8 liters) of water was prepared and added five days later to the brine box of element 1 from where it was introduced into the anolyte compartment of the electrolyzer element. Ten days later, analysis of the catholyte liquor showed that the NaOH concentration to be 174.45 gpl and the NaOCl concentration to be 0.2 ppm. The Oxy '6' efficiency of the electrolyzer at this time was calculated to be 89.4%. The electrolyzer continued to operate for approximately 3 additional months during which the NaOH and NaOCl concentrations in the catholyte liquor were within acceptable limits for the circuit load applied to the electrolyzer.

Example 3

Analysis of the catholyte liquor from element No. 8 of a bipolar fingered chlor-alkali electrolyzer from a different circuit than that of Examples 1 and 2 showed a sodium hydroxide (NaOH) concentration of 126 gpl, and a hypochlorite ion concentration (as sodium hypochlorite-NaOCl) of 21 ppm. The Oxy '6' efficiency of the electrolyzer at this time was calculated to be 93.5%. A doping solution of 3 pounds (1.35 kg) of polytetrafluoroethylene (PTFE) short floc fibers, 2 gallons (7.57 liters) of PTFE microfibrils (10 wt. % solids) and 50 gallons (189 liters) of water was prepared and added to the brine box for element 8 from where it was introduced into the anolyte compartment of the electrolyzer element. Six days later, analysis of the catholyte liquor from element 8 showed a sodium hydroxide concentration of 121 gpl and a hypochlorite ion concentration (as sodium hypochlorite) of 0 (zero) ppm. The Oxy '6' current efficiency of the electrolyzer at this time was calculated to be 95.6%. Twenty Eight days later, analysis of the catholyte liquor from element 8 showed a sodium hydroxide concentration of 143 gpl, a hypochlorite ion concentration (as sodium hypochlorite) of 0 (zero) and an Oxy '6' current efficiency of 94.1%.

Example 4

Analysis of the catholyte liquor from element No. 7 of a bipolar fingered chlor-alkali electrolyzer from the same circuit as that of Example 3 showed a sodium hydroxide (NaOH) concentration of 131 gpl, and a hypochlorite ion concentration (as sodium hypochlorite-NaOCl) of 26 ppm. The Oxy '6' efficiency of the electrolyzer at this time was calculated to be 91.2%. A doping solution of 3 pounds (1.35 kg) of polytetrafluoroethylene (PTFE) short floc fibers, 2 gallons (7.57 liters) of PTFE microfibrils (10 wt. % solids) and 50 gallons (189 liters) of water was prepared and added to the brine box for element 7 from where it was introduced into the anolyte compartment of the electrolyzer element. Seven days later analysis of the catholyte liquor from element 7 showed a sodium hydroxide concentration of 138 gpl and a hypochlorite ion concentration (as sodium hypochlorite) of 6 ppm. The Oxy '6' current efficiency of the electrolyzer at this time was calculated to be 92.9%.

Example 5

Analysis of the catholyte liquor from element No. 2 of a bipolar fingered chlor-alkali electrolyzes from a circuit different from that of Examples 1-4 showed a sodium hydroxide (NaOH) concentration of 131 gpl, and a hypochlorite ion concentration (as sodium hypochlorite-NaOCl) of 33 ppm. The Oxy '6' efficiency of the electrolyzer at this time was calculated to be 91.2%. A doping solution of 3 pounds (1.35 kg) of polytetrafluoroethylene (PTFE) short floc fibers, 2 gallons (7.57 liters) of PTFE microfibrils (10 wt. % solids) and 50 gallons (189 liters) of water was prepared and added to the brine box for element 2 from where it was introduced into the anolyte compartment of the electrolyzer element. Seven days later analysis of the catholyte liquor from element 2 showed a sodium hydroxide concentration of 168 gpl and a hypochlorite ion concentration (as sodium hypochlorite) of 4 ppm. The Oxy '6' current efficiency of the electrolyzer at this time was calculated to be 93%. About 4 months later analysis of the catholyte liquor from element 2 showed a sodium hydroxide concentration of 133 gpl and a hypochlorite ion concentration (as sodium hypochlorite) of 1 ppm. The Oxy '6' efficiency of the electrolyzer at this time was calculated to be 95%.

The Examples demonstrate that the addition of a dopant comprising short floc fibers of PTFE reduce the flow of electrolyte through a synthetic diaphragm of a chlor-alkali diaphragm electrolytic cell, with the consequent result of lowering the concentration of hypochlorite ion (as sodium hypochlorite) in the catholyte liquor and in most cases increasing the concentration of sodium hydroxide in the catholyte liquor.

While, the present invention has been described with reference to specific details of particular embodiments thereof, it is not intended that such details be regarded as limitations upon the scope of the invention except insofar as and to the extent that they are included in the accompanying claims.

What is claimed is:

1. A method for improving the operation of an electrolytic cell comprising an anolyte compartment, a catholyte compartment and a synthetic diaphragm separating the anolyte and catholyte compartments wherein liquid anolyte is introduced into the anolyte compartment and flows through the diaphragm into the catholyte compartment, which method consists of introducing into the anolyte compartment particulate material consisting of halocarbon polymer short fiber and halocarbon polymer microfibril, and optionally at least one member chosen from halocarbon polymer fiber having a mean length longer than the mean length of the halocarbon polymer short fiber, clay mineral, hydroxides of alkaline earth metals, and zirconium hydroxide in amounts sufficient to lower the flow of liquid anolyte through the synthetic diaphragm into the catholyte compartment, by said particulate material being deposited on an anolyte side surface of said synthetic diaphragm, wherein the weight ratio of halocarbon polymer short fiber to halocarbon polymer microfibril is from 0.4:1 to 1.5:1.

2. The method of claim 1 wherein the electrolytic cell is a chlor-alkali electrolytic cell.

3. The method of claim 2 wherein the halocarbon polymer short fiber is a fluorocarbon polymer.

4. The method of claim 3 wherein the fluorocarbon polymer short fiber, the halocarbon polymer microfibril and the halocarbon polymer fiber are polymers of tetrafluoroethylene.

5. The method of claim 4 wherein the particulate material is introduced into the anolyte compartment while the electrolytic cell is operating.

6. The method of claim 5 wherein the particulate material introduced into the anolyte compartment of the electrolytic cell consists of tetrafluoroethylene polymer short fiber and clay mineral.

7. The method of claim 6 wherein the clay mineral is attapulgite clay.

8. The method of claim 5 wherein the particulate material introduced into the anolyte compartment of the electrolytic cell consists of tetrafluoroethylene polymer short fiber and tetrafluoroethylene polymer microfibril.

9. The method of claim 8 wherein clay mineral is introduced into the anolyte compartment prior to or subsequent to the introduction of the tetrafluoroethylene polymer short fiber and tetrafluoroethylene polymer microfibril.

10. The method of claim 9 wherein the clay mineral is attapulgite clay.

11. The method of claim 1 wherein the liquid anolyte comprises alkali metal chloride and the alkali metal chloride is sodium chloride.

* * * * *